United States Patent [19]

Laskaris

[11] Patent Number: 5,023,584

[45] Date of Patent: Jun. 11, 1991

[54] MAGNET CARTRIDGE FOR MAGNETIC RESONANCE MAGNET

[75] Inventor: Evangelos T. Laskaris, Schenectady, N.Y.

[73] Assignee: General Electric Company, Schenectady, N.Y.

[21] Appl. No.: 395,636

[22] Filed: Aug. 17, 1989

[51] Int. Cl.[5] ..... H01F 7/22

[52] U.S. Cl. ..... 335/216; 174/125.1

[58] Field of Search ..... 335/216, 299; 174/125.1; 324/318, 319, 320

[56] References Cited

U.S. PATENT DOCUMENTS

| | | | |
|---|---|---|---|
| 3,177,408 | 4/1965 | Mills et al. | 335/216 X |
| 4,622,531 | 11/1986 | Eyssa et al. | 335/216 |
| 4,881,035 | 11/1989 | Siebold | 335/216 X |
| 4,912,444 | 3/1990 | Dederer et al. | 335/216 |

*Primary Examiner*—George Harris

*Attorney, Agent, or Firm*—James R. McDaniel; James C. Davis, Jr.; Paul R. Webb, II

[57] ABSTRACT

A cylindrical sleeve of thermally conductive material is provided together with two epoxy impregnated superconductive coils. The cylindrical sleeve defines a circumferentially extending rabbet on either end of the sleeve on the inner diameter. The edge of the outer diameter of each coil is secured in one of the rabbets in the sleeve.

13 Claims, 3 Drawing Sheets

MAGNET CARTRIDGE FOR MAGNETIC RESONANCE MAGNET

CROSS REFERENCE TO RELATED APPLICATIONS

The present invention is related to the following copending applications: Ser. No. 395,635 entitled "Epoxy-Impregnated Superconductive Tape Coils"; Ser. No. 395,637 now U.S. Pat. No. 4,986,078 and Ser. No. 395,637, entitled "Demountable Coil Form for Epoxy-Impregnated Coils".

BACKGROUND OF THE INVENTION

The present invention is related to magnetic resonance (MR) magnet cartridges which includes the magnet coils and support that position the coils relative to one another.

Superconducting coils in an MR magnet are typically supported by a cylindrical shell which also serves as a winding form or by rings shrunk on the outside surface of freestanding coils which are joined to one another by axial struts. When a cylindrical shell serves as a winding form, the entire cartridge including all the coils is epoxy impregnated at the same time. A defective coil is not easily repaired and can cause the entire cartridge to be scrapped. When individual coils with shrunk on rings are assembled, achieving precise alignment of the coils relative to one another can be difficult, any misalignment adversely affects the magnetic field homogeneity which can be achieved by the magnet.

In refrigerated magnets, the support structure between the coils also serves to carry heat away from the coils to the cryocooler. The more support structure provided to improve heat conduction, the greater the weight of the magnet cartridge and the larger the suspension needed to support the magnet cartridge in the vacuum vessel, which adds to the heat load conducted through the suspension to the magnet cartridge.

It is an object of the present invention to provide a magnet cartridge with reduced weight and good heat transfer between coils.

It is a further object of the present invention to provide a magnet cartridge which permits precise alignment of the coils during fabrication.

It is a still object of the present invention to provide a magnet cartridge which permits cost effect replacement of a defective coil.

SUMMARY OF THE INVENTION

In one aspect of the present invention, a cylindrical sleeve of thermally conductive material is provided together with two epoxy impregnated superconductive coils. The cylindrical sleeve defines a circumferentially extending rabbet on either end of the sleeve on the inner diameter. The edge of the outer diameter of each coil is secured in one of the rabbets in the sleeve.

BRIEF DESCRIPTION OF THE DRAWING

While the specification concludes with claims particularly pointing out and distinctly claiming the present invention, the objects and advantages can be more readily ascertained from the following description of a preferred embodiment when read in conjunction with the accompanying drawing in which:

DETAILED DESCRIPTION OF THE INVENTION

Figure 1:
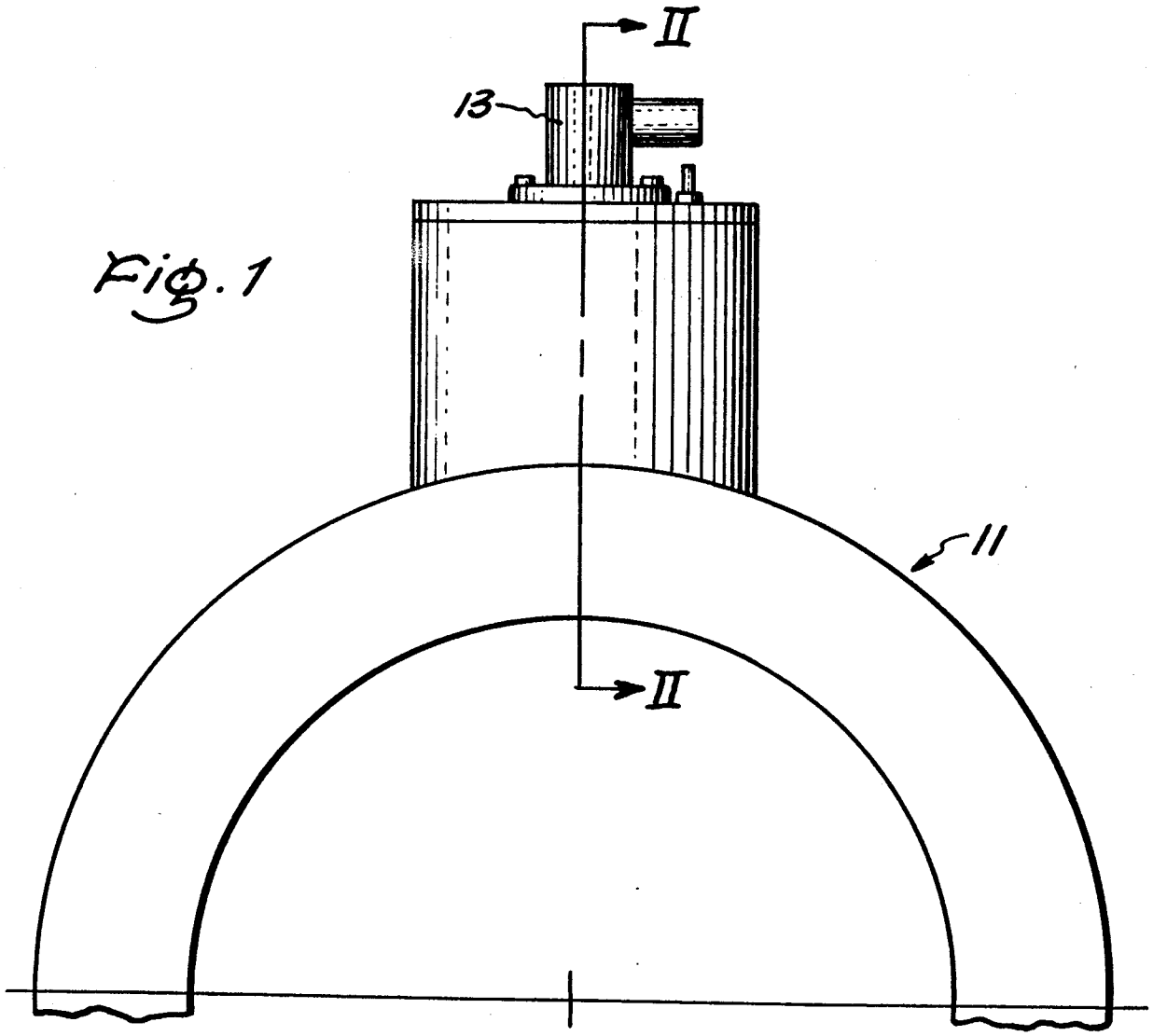
FIG. 1 is a partial end view of an MR magnet vacuum vessel cooled by a two stage cryocooler.
Figure 2:
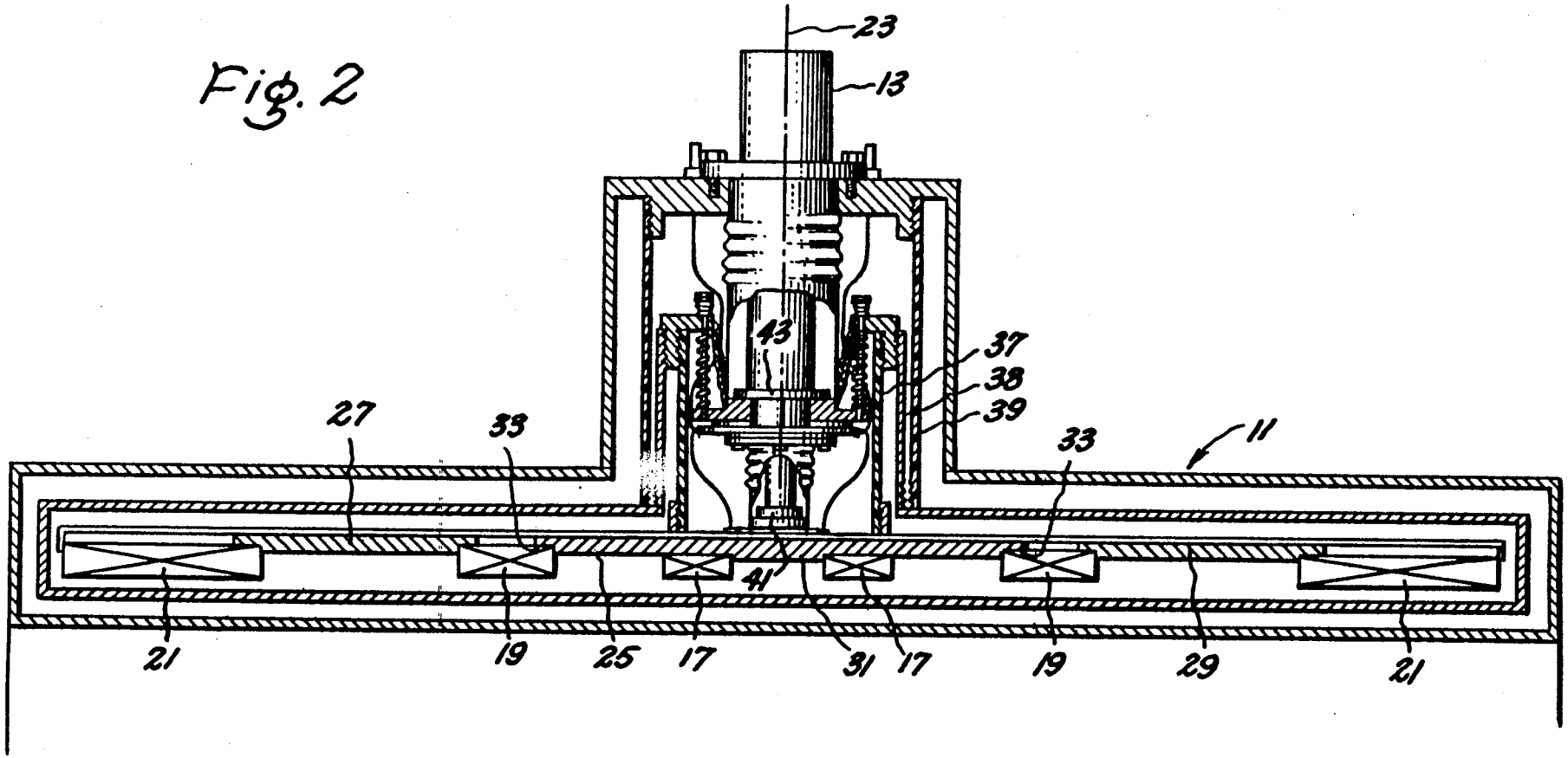
FIG. 2 is a side view taken along lines II—II in FIG. 1 showing a magnet cartridge in accordance with the present invention situated in the vacuum vessel.

Referring now to the drawing and particularly FIG. 1, thereof, a partial end view of an MR magnet vacuum vessel 11 cooled by a two stage cryocooler 13 is shown. FIG. 2 shows a magnet cartridge 15 having three pairs of superconductive coils 17, 19, and 21 situated in the vacuum vessel. The pairs of coils are located symmetrically about the axial midplane of the magnet cartridge and are concentric with one another. Each of the coils comprises a freestanding epoxy impregnated superconductive coil.

Cylindrical spacers are used to position the coil relative to one another. In the present embodiment three spacers 25, 27 and 29 are used. The cylindrical spacers can be fabricated from rolled and welded aluminum or copper alloys which are stress relieved prior to machining. The center sleeve 25 is machined to provide an inwardly extending centrally located shoulder 31 on the inside of the sleeve. The center sleeve is further machined on either end to form a rabbet on the inner diameter on either axial end. The other two spacers 27 and 29 are machined at either end to form a circumferentially extending rabbet at their inner diameters. The three spacers are positioned spaced apart from one another and concentric about a common axially extending axis. The innermost pair of coils 17 are positioned inside the central spacer butting up against the centrally located shoulder 31 on the inside of the sleeve. Positioned between the central spacer 31 and two outer spacers 27 and 29 in the rabbets are the second coil pair 19. The third pair of coils 21 are supported concentrically with the other coils in a cantilever fashion from the ends of the outer spacers 27 and 29 with the ends of the coils positioned in the rabbeted ends of the spacers. The spacers can be heated prior to inserting the ends of the coils to achieve a shrink fit. Each of the rabbeted joints is bonded with epoxy resin to provide low thermal contact resistance. The outer two sleeves 27 and 29 can alternatively be fabricated from fiberglass composite with copper foils or wire embedded in the composite to enhance thermal conductivity.

Each coil in three coil pairs is helically wound with either superconductive tape or superconductive wire with hardened, preferably perforated, copper closed loops inserted among the winding layers and a plurality of layers with intermediately placed glass cloth wound over the entire diameter of the coil, prior to epoxy impregnation. A superconductive tape epoxy impregnated coil of the type shown and claimed in copending application Ser. No. 346,760 entitled "Epoxy-Impregnated Superconductive Tape Coil" and hereby incorporated by reference can be used. The coils whether wound with superconductive tape or superconductive wire can be fabricated using a demountable coil form, such as the one shown and claimed in copending application Ser. No. 395,634 entitled "Demountable Coil Form for Epoxy Impregnated Coils" and herein incorporated by reference.

Figure 3:
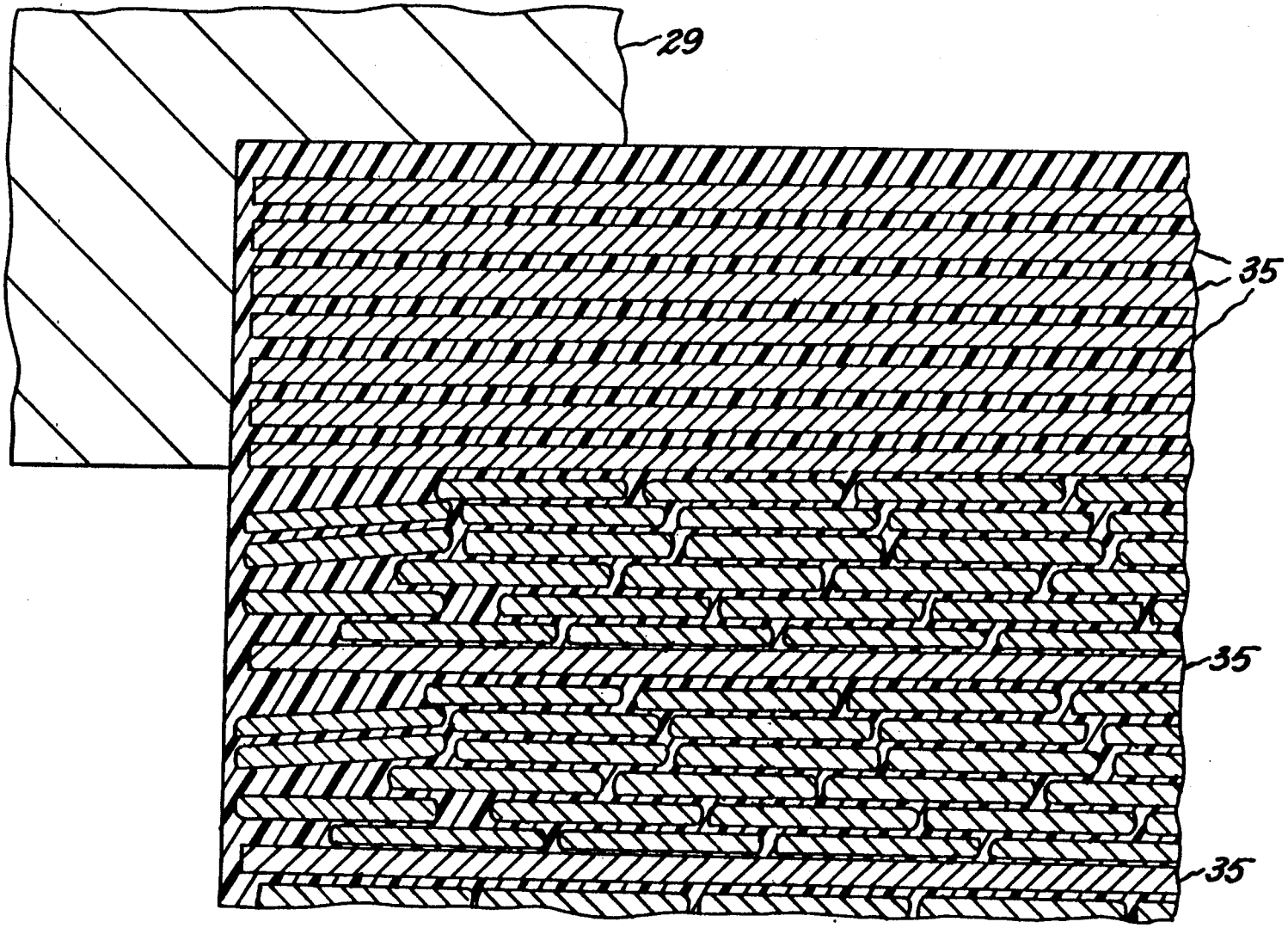
FIG. 3 is a sectional of a portion of a sleeve and epoxy impregnated coil of FIG. 2.

A portion of a freestanding epoxy impregnated superconductive tape coil 21 with one edge situated in a rabbet of a sleeve 29 is shown in FIG. 3. Each superconducting coil is self supported against the radially outward electromagnetic forces that occur when the coils are energized, by the hardened copper foil loops 35 and foil overwrap 35. The foil overwrap is provided with a sufficient thickness so that it coincides with the portion of the coil extending into the rabbet in the sleeve. The spacers provide support only against the axially inward directed forces which attempt to force the coils to the axial midplane of the cartridge when the coils are energized. The cylindrical spacers locate the coils precisely relative to one another.

The magnet cartridge can be supported in the vacuum vessel as shown in FIG. 2 by the three concentric tubes 37, 38 and 39 located in the vacuum vessel extension which also houses the cold end. The second stage 41 of the cryocooler removes heat from the magnet cartridge by conduction. The first stage 43 of the cryocooler is in thermal contact through concentric tube 38, with a thermal radiation shield which surrounds the magnet cartridge. Concentric tubes 37 and 39 are fabricated from material having low thermal conductivity. Concentric tube 38 is fabricated from material having high thermal conductivity. The magnet cartridge support system is described and claimed in U.S. Pat. No. 4,986,078 entitled "Refrigerated MR Magnet Support System" and hereby incorporated by reference. Any of the existing magnet cartridge support systems can be used with the magnet cartridge of the present invention such as struts or cables with the suspension system secured to the sleeve-portions of the magnet cartridge. The radiation shield can also be supported by the magnet cartridge if desired.

The foregoing has described a magnetic cartridge for a magnetic resonance magnet which has reduced weight and provides precise alignment between coils.

While the invention has been particularly shown and described with reference to an embodiment thereof, it will be understood by those skilled in the art that various changes in form and detail may be made without departing from the spirit and scope of the invention.

What is claimed is:

1. A magnet cartridge for use in MR magnets comprising:

a cylindrical sleeve of thermally conductive material defining a circumferentially extending rabbet on either end of the sleeve on the inner diameter;

two epoxy impregnated superconductive coils having the edge of outer diameter of each coil secured in one of the rabbets in said sleeve.

2. The magnet cartridge of claim 1 wherein each of said epoxy impregnated coil has a plurality of epoxy impregnated metal layers surrounding the superconductive windings, the radial thickness of said conductive metal loops corresponding to the radial height of the rabbet, so that the outer diameter of the coil having the epoxy impregnated metal layers extends into said rabbet.

3. The magnet cartridge of claim 2 wherein said plurality of metal layers comprises a plurality of electrically shorted loops surrounding the coil.

4. The magnet cartridge of claim 3 wherein said metal layers are fabricated from hardened copper.

5. The magnet cartridge of claim 4 wherein said metal layers are perforated.

6. The magnet cartridge of claim 4 wherein said magnet cartridge further comprises electrically shorted loops distributed throughout the superconductive windings between selected layers.

7. A magnet cartridge for use in MR magnets comprising:

a center cylindrical sleeve and two outer cylindrical sleeves of thermally conductive material, each sleeve defining circumferentially extending rabbets on the inner diameter of either end of the sleeve, said outer axially sleeves, spaced apart on either side of said center sleeve, all three sleeves concentrically situated about a common axially extending axis;

two pairs of epoxy impregnated superconductive coils, one pair of said coils situated symmetrically on either side of said center sleeve between said center and outer sleeves, with the outer diameter edges of said coils located in the rabbets of said center and outer sleeves, the second pair of coils each having the outer diameter edge situated in the rabbets in the outer sleeves, with the outer pair of coils supported in cantilevered fashion.

8. The magnet cartridge of claim 7 wherein each of said epoxy impregnated coil has a plurality of epoxy impregnated metal layers surrounding the superconductive windings, the radial thickness of said conductive metal loops corresponding to the radial height of the rabbet, so that the outer diameter of the coil having the epoxy impregnated metal layers extends into said rabbet.

9. The magnet cartridge of claim 8 wherein said plurality of metal layers comprises a plurality of electrically shorted loops surrounding the coil.

10. The magnet cartridge of claim 9 wherein said metal layers are fabricated from hardened copper.

11. The magnet cartridge of claim 10 wherein said metal layers are perforated.

12. The magnet cartridge of claim 10 wherein said magnet cartridge further comprises electrically shorted loops distributed throughout the superconductive windings between selected layers.

13. The magnet cartridge of claim 7 further comprising a third pair of epoxy impregnated superconductive coils, said inner sleeve defining a radially inwardly extending centrally located shoulder, said third pair of coils situated inside of said inner sleeve on either side of said shoulder.

* * * * *